US008384294B2

(12) United States Patent
Hatley et al.

(10) Patent No.: US 8,384,294 B2
(45) Date of Patent: Feb. 26, 2013

(54) SYSTEM AND METHOD FOR COLOR CREATION AND MATCHING

(75) Inventors: Troy Bryan Hatley, Lodi, WI (US); Timothy George Robbins, Lodi, WI (US); Mike Wood, Austin, TX (US)

(73) Assignee: Electronic Theatre Controls, Inc., Middleton, WI (US)

( * ) Notice: Subject to any disclaimer, the term of this patent is extended or adjusted under 35 U.S.C. 154(b) by 183 days.

(21) Appl. No.: 12/898,127

(22) Filed: Oct. 5, 2010

(65) Prior Publication Data

US 2012/0081010 A1 Apr. 5, 2012

(51) Int. Cl.
*H05B 37/02* (2006.01)

(52) U.S. Cl. ..... 315/149; 315/158; 315/291

(58) Field of Classification Search ..... 315/149–159, 315/291, 294, 297, 307–309, 312; 345/589, 345/591, 597, 600

See application file for complete search history.

(56) References Cited

U.S. PATENT DOCUMENTS

| | | | | |
|---|---|---|---|---|
| 5,350,977 | A | 9/1994 | Hamamoto et al. | |
| 5,636,303 | A | 6/1997 | Che et al. | |
| 6,510,995 | B2 | 1/2003 | Muthu et al. | |
| 6,572,977 | B1 | 6/2003 | Pavelka et al. | |
| 6,576,881 | B2 | 6/2003 | Muthu et al. | |
| 6,603,271 | B2 | 8/2003 | Noh | |
| 6,683,423 | B2 | 1/2004 | Cunningham | |
| 6,888,322 | B2 * | 5/2005 | Dowling et al. | 315/292 |
| 6,967,447 | B2 | 11/2005 | Lim et al. | |
| 7,012,382 | B2 | 3/2006 | Cheang et al. | |
| 7,023,543 | B2 | 4/2006 | Cunningham | |
| 7,030,574 | B2 | 4/2006 | Lim et al. | |
| 7,067,995 | B2 | 6/2006 | Gunter et al. | |
| 7,178,941 | B2 | 2/2007 | Roberge et al. | |
| 7,230,222 | B2 | 6/2007 | Cheng et al. | |
| 7,233,831 | B2 | 6/2007 | Blackwell | |

(Continued)

FOREIGN PATENT DOCUMENTS

| | | |
|---|---|---|
| DE | 102007059130 | 6/2009 |
| JP | 20098110715 | 5/2009 |

(Continued)

OTHER PUBLICATIONS

International Search Report and Written Opinion for Applicatino No. PCT/US2011/054747 dated Mar. 15, 2012 (10 pages).

(Continued)

*Primary Examiner* — Tung X Le
(74) *Attorney, Agent, or Firm* — Michael Best & Friedrich LLP

(57) ABSTRACT

Systems and methods for controlling an output of a luminaire. The luminaire uses stored spectral information for light sources within the luminaire to determine a coordinate for each light source within a color space. A desired output color is also converted to a coordinate within the color space. The distance between the desired output color coordinate and each of the coordinates corresponding to the light sources is calculated to select initial control values for the light sources. The initial control values for each light source are individually modified by a step size value, the total output of the luminaire is calculated and converted to a coordinate within the color space, and the distance between the total luminaire output coordinate and the desired color coordinate is calculated. The control values for the light sources are iteratively modified until the luminaire output coordinate is within a threshold value of the desired color output.

23 Claims, 14 Drawing Sheets

U.S. PATENT DOCUMENTS

| | | | | |
|---|---|---|---|---|
| 7,288,902 | B1 | 10/2007 | Melanson | |
| 7,319,298 | B2 | 1/2008 | Jungwirth et al. | |
| 7,348,949 | B2 | 3/2008 | Lee et al. | |
| 7,354,172 | B2 | 4/2008 | Chemel et al. | |
| 7,358,961 | B2 | 4/2008 | Zwanenburg | |
| 7,387,405 | B2 | 6/2008 | Ducharme et al. | |
| 7,394,210 | B2 | 7/2008 | Ashdown | |
| 7,513,671 | B2 | 4/2009 | Ng et al. | |
| 7,521,872 | B2 | 4/2009 | Bruning | |
| 7,560,677 | B2 | 7/2009 | Lyons et al. | |
| 7,573,209 | B2 | 8/2009 | Ashdown et al. | |
| 7,598,684 | B2 | 10/2009 | Lys et al. | |
| 7,598,686 | B2 | 10/2009 | Lys et al. | |
| 7,604,378 | B2 | 10/2009 | Wolf et al. | |
| 7,619,193 | B2 | 11/2009 | Deurenberg | |
| 7,619,370 | B2 | 11/2009 | Chemel et al. | |
| 7,638,956 | B2 | 12/2009 | Liu et al. | |
| 7,710,369 | B2 | 5/2010 | Dowling | |
| 7,718,942 | B2 | 5/2010 | Lim et al. | |
| 7,759,854 | B2 | 7/2010 | Miller et al. | |
| 7,759,882 | B2 | 7/2010 | Korcharz et al. | |
| 7,767,948 | B2 | 8/2010 | May et al. | |
| 7,781,979 | B2 | 8/2010 | Lys | |
| 7,786,678 | B2 | 8/2010 | Kurt et al. | |
| 8,022,632 | B2 * | 9/2011 | Schulz et al. | 315/149 |
| 8,084,948 | B2 * | 12/2011 | Van Der Veen et al. | 315/151 |
| 2004/0212320 | A1 * | 10/2004 | Dowling et al. | 315/291 |
| 2005/0151489 | A1 * | 7/2005 | Lys et al. | 315/308 |
| 2005/0218838 | A1 * | 10/2005 | Lys | 315/291 |
| 2006/0139914 | A1 | 6/2006 | Yoganandan et al. | |
| 2006/0187236 | A1 | 8/2006 | Runnels et al. | |
| 2006/0226795 | A1 | 10/2006 | Walter et al. | |
| 2006/0226956 | A1 | 10/2006 | Young et al. | |
| 2006/0237636 | A1 | 10/2006 | Lyons et al. | |
| 2006/0290710 | A1 | 12/2006 | Zwanenburg | |
| 2007/0076014 | A1 | 4/2007 | De Vaan | |
| 2007/0235639 | A1 | 10/2007 | Rains, Jr. | |
| 2008/0203945 | A1 | 8/2008 | Deurenberg et al. | |
| 2008/0218095 | A1 | 9/2008 | Erhardt | |
| 2008/0246419 | A1 | 10/2008 | Deurenberg | |
| 2010/0002440 | A1 | 1/2010 | Negley et al. | |
| 2010/0027257 | A1 | 2/2010 | Boonekamp et al. | |
| 2010/0052560 | A1 | 3/2010 | Li et al. | |
| 2010/0060171 | A1 | 3/2010 | Goitiandia et al. | |
| 2010/0079059 | A1 | 4/2010 | Roberts et al. | |
| 2010/0097406 | A1 | 4/2010 | Zulch | |
| 2010/0097407 | A1 | 4/2010 | Zulch | |
| 2010/0110672 | A1 | 5/2010 | Durand et al. | |
| 2010/0128472 | A1 | 5/2010 | Hancock et al. | |
| 2010/0171444 | A1 | 7/2010 | Bennette | |
| 2010/0188022 | A1 | 7/2010 | Gerlach et al. | |
| 2012/0176063 | A1 | 7/2012 | Hatley et al. | |

FOREIGN PATENT DOCUMENTS

| | | |
|---|---|---|
| WO | 2006/069002 | 6/2006 |
| WO | 2007/033667 | 3/2007 |
| WO | 2007083250 | 7/2007 |
| WO | 2008/006205 | 1/2008 |
| WO | 2008/068713 | 6/2008 |
| WO | 2008/072138 | 6/2008 |
| WO | 2008/078274 | 7/2008 |
| WO | 2008/142622 | 11/2008 |
| WO | 2009/024903 | 2/2009 |
| WO | 2010/080651 | 7/2010 |
| WO | 2012/0081010 | 4/2012 |
| WO | 2012/096733 | 7/2012 |
| WO | 2012/096734 | 7/2012 |

OTHER PUBLICATIONS

International Search Report and Written Opinion for Application No. PCT/US2011/063965 dated Feb. 28, 2012 (9 pages).
International Search Report and Written Opinion for Application No. PCT/US2011/063961 dated Apr. 27, 2012 (10 pages).
Copending U.S. Appl. No. 13/004,931, filed Jan. 12, 2011.
Copending U.S. Appl. No. 13/004,922, filed Jan. 12, 2011.
Notification concerning informal communications with the applicant for Application No. PCT/US2011/054747 dated Oct. 10, 2012 (5 pages).
International Preliminary Report on Patentability for Application No. PCT/US2011/054747 dated Nov. 12, 2012 (21 pages).

* cited by examiner

210

215

220

225

SYSTEM AND METHOD FOR COLOR CREATION AND MATCHING

BACKGROUND

This invention relates to color creation and matching.

Luminaires or light fixtures are capable of reproducing a wide gamut of colors by combining light from, for example, a plurality of LED light sources. However, conventional methods for controlling the output of such luminaires are often unable to accurately reproduce a desired color. The output of the luminaire is limited by, among other things, the number of light sources included in the luminaire and the respective outputs of those light sources.

A convenient way of visualizing the color gamut of a luminaire is using the International Commission on Illumination ("CIE") 1931 color space chromaticity diagram 10 illustrated in FIG. 1. The CIE 1931 color space chromaticity diagram 10 is a two-dimensional representation of the colors in the visible spectrum in which each color is identified by an x-y coordinate (i.e., (x, y)). The CIE 1931 color space incorporates the use of tristimulus values that correspond to the amounts of three primary colors in a three-component additive color model that are needed to match a target color. The tristimulus values, denoted by X, Y, and Z, are derived parameters that are used to represent the human eye's response to red, green, and blue colors.

The tristimulus values are dependent on an observer's field-of-view ("FOV"). To eliminate this dependence, a standard observer is defined which corresponds to a 2° FOV. The standard observer is described numerically with respect to three color matching functions given by $\bar{x}(\lambda)$, $\bar{y}(\lambda)$, and $\bar{z}(\lambda)$, as shown graphically in diagram 15 of FIG. 2. The color matching functions are used to calculate the tristimulus values X, Y, and Z, as shown below.

$$X = \int_0^\infty I(\lambda)\bar{x}(\lambda)\,d\lambda, \qquad \text{EQN. 1}$$

$$Y = \int_0^\infty I(\lambda)\bar{y}(\lambda)\,d\lambda \qquad \text{EQN. 2}$$

and, $$Z = \int_0^\infty I(\lambda)\bar{z}(\lambda)\,d\lambda \qquad \text{EQN. 3}$$

The chromaticity of a color is then defined in terms of an x-y coordinate. The Y tristimulus value is used as a measure of brightness or luminance. The x-y coordinate can be calculated as a function of the tristimulus values X, Y, and Z, as shown below in EQNS. 4-6.

$$x = \frac{X}{(X+Y+Z)}, \qquad \text{EQN. 4}$$

$$y = \frac{Y}{(X+Y+Z)} \qquad \text{EQN. 5}$$

and, $$z = \frac{Z}{(X+Y+Z)} = 1 - x - y \qquad \text{EQN. 6}$$

The color space specified by the x-y coordinate and the Y tristimulus value, known as the CIE xyY color space, is often used to identify colors.

SUMMARY

The use of the CIE xyY color space, and particularly an x-y coordinate to identify colors, provides a consistent technique for selecting color outputs of luminaires or light fixtures. However, the use of the CIE xyY color space or other color spaces fail to account for variations in the individual light sources. For example, the production of LEDs for use in LED light sources is not an exact process. The outputs of individual LEDs and, when combined, the output of groups of LEDs have variations in their light production characteristics which affect the total output of a luminaire. For example, two light sources including one or more LEDs can output slightly different colors even though they are supposedly the same. The differences include, for example, differences in wavelengths, frequencies, intensities, polarizations, phases, color temperature, brightness, saturation, etc. These differences should be accounted for in order to properly and precisely reproduce a desired color. As a result of these differences, complex color control methodologies (e.g., hue-saturation-intensity ("HSI"), red-green-blue ("RGB"), etc.) do not translate to a consistent output across multiple fixtures or families of luminaires.

Existing techniques used to address some of these differences utilize complex mathematical equations to solve for a correct solution (e.g., the correct output levels for light sources). However, such techniques are computationally intensive and require high-powered central processing units in order to arrive at the correct combination of light source outputs. Additionally, due to the processing power required, the calculations must be performed apart from an individual luminaire. It is not economical to provide each luminaire with the computational resources necessary to perform such calculations. As such, a color creation and matching technique that is less computationally intensive and capable of being performed by the luminaire provides a system of luminaires in which the correct output for each luminaire is obtained based on a set of input controls (i.e., a desired color). Determining the output of each luminaire is then not dependent upon a powerful central computer that calculates the output of each light source for each luminaire.

Accordingly, the invention provides systems and methods for producing a correct light output from a luminaire or light fixture and compensating for variations in the output characteristics of light sources. To compensate for the variations in the output characteristics of light sources and normalize desired color inputs into a single cohesive color space (e.g., the CIE xyY color space), the outputs of individual light sources are iteratively modified and evaluated until the outputs necessary to produce the desired color are identified. For example, a desired color is inputted to the luminaire using a color control methodology (e.g., HSI, RGB, etc.). The desired color is converted to a coordinate within the color space, and the output of each of the light sources is also converted to a color coordinate within the color space based on, for example, spectral data.

The separation (e.g., a distance) between the desired color coordinate and the coordinates corresponding to each of the light sources is calculated to select initial control values (e.g., output intensity values) for the light sources. For small separations between the coordinates corresponding to each of the light sources and the desired output color coordinate, the initial control value for the light source is set to a high value. For large separations between the coordinates corresponding to each of the light sources and the desired output color coordinate, the initial control value for the light source is set to a low value. The initial control values for each light source are then individually modified by a step size value, the total output of the luminaire is calculated and converted to a coordinate within the color space, and the separation between the total luminaire output coordinate and the desired color coordinate is calculated. The control values for the light sources are iteratively modified until the total luminaire output coordinate is within a selected error or threshold value of the desired color output. The light sources in the luminaire are then driven to the identified control values.

In one implementation, the invention provides a method of controlling the output of a light fixture that includes a light source. The method includes determining a desired color location within a color space, determining a light source location within the color space for the light source, and calculating a first separation between the desired color location and the light source location. The method also includes setting a control value for the light source based on the first separation, modifying the control value for the light source, and calculating a light fixture output based on the modified control value. A light fixture output location within the color space is then determined based on the light fixture output, a second separation between the light fixture output location and the desired color location is determined, and the light source is driven based on the modified control value.

In another implementation, the invention provides a method of controlling the output of a light fixture that includes a light source. The method includes the steps of (1) determining a desired color location within a color space, (2) determining a light source location within the color space for the light source, and (3) calculating a first separation between the desired color location and the light source location. The method also includes the steps of (4) setting a control value for the light source based on the first separation, (5) modifying the control value for the light source, and (6) calculating a light fixture output based on the modified control value. After the light fixture output has been calculated, the method includes the steps of (7) determining a light fixture output location within the color space based on the calculated light fixture output, (8) calculating a second separation between the light fixture output location and the desired color location, and (9) comparing the second separation to a predetermined threshold value. Steps 5-9 are then iteratively performed, and the light source is driven based on the modified control value.

In one construction, the invention provides a light fixture that includes a light source and a controller. The controller is configured to determine a desired color location within a color space, determine a light source location within the color space for the light source, and calculate a first separation between the desired color location and the light source location. The controller is also configured to set a control value for the light source based on the first separation, modify the control value for the light source, and calculate a light fixture output based on the modified control value. The controller then determines a light fixture output location within the color space based on the light fixture output, calculates a second separation between the light fixture output location and the desired color location, and compares the second separation to a threshold value. The light source is then driven based on the modified control value.

Other aspects of the invention will become apparent by consideration of the detailed description and accompanying drawings.

DETAILED DESCRIPTION

Figure 1:
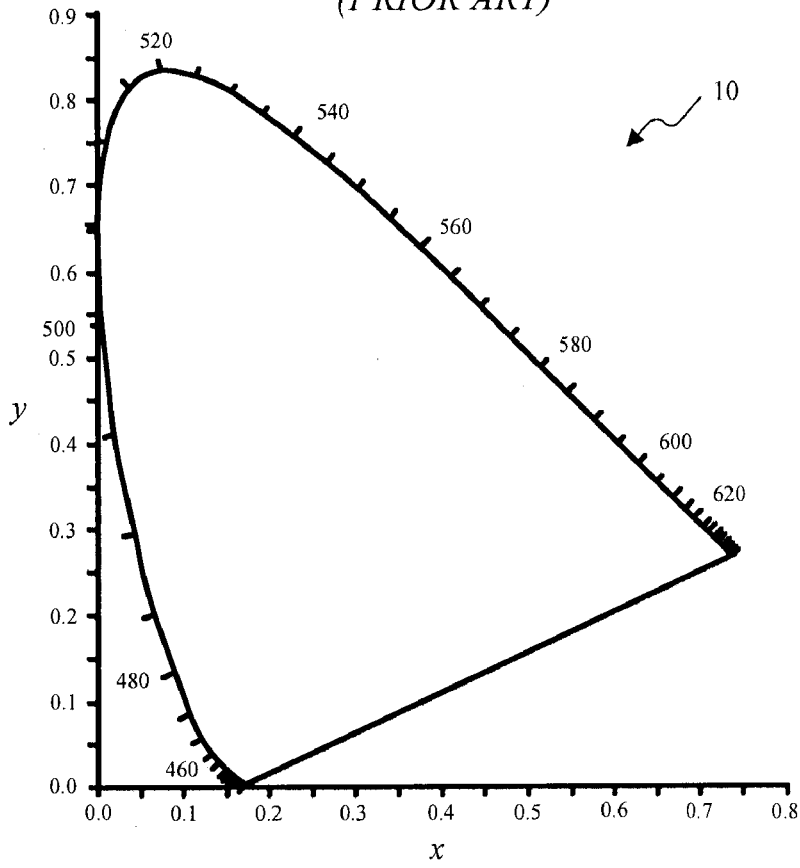
FIG. 1 (PRIOR ART)
FIG. 1 is the International Commission on Illumination ("CIE") 1931 color space chromaticity diagram.
Figure 2:
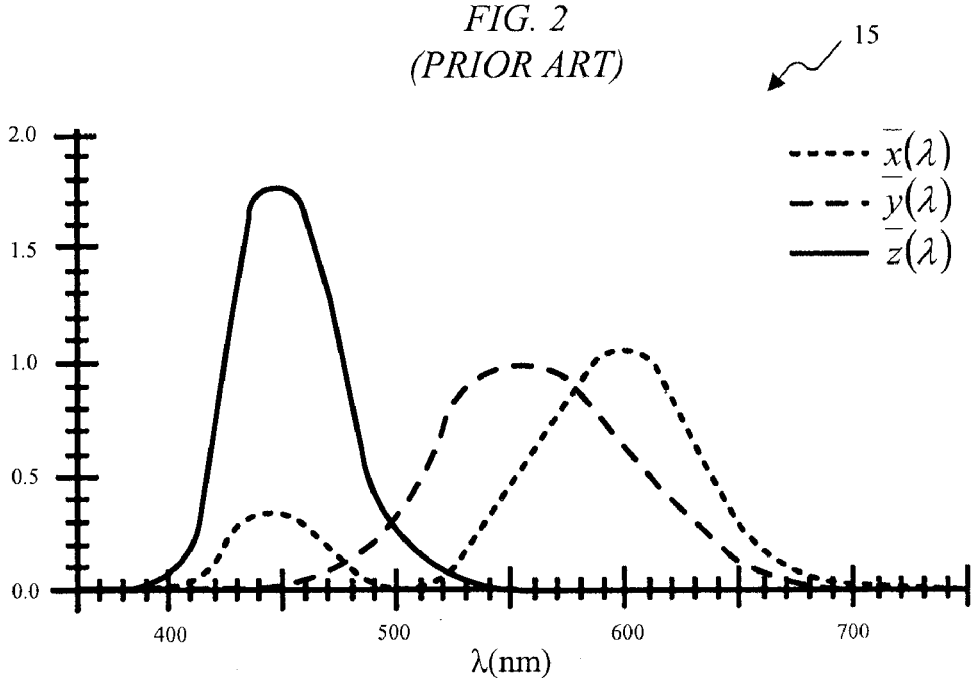
FIG. 2 (PRIOR ART)
FIG. 2 illustrates the CIE 1931 XYZ color matching functions.

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

The invention described herein relates to systems and methods for controlling the output of a luminaire or light emitting diode ("LED") light fixture. As described above, variations in the output of individual LEDs affect the ability of a luminaire to reproduce a desired color. In order to compensate for these variations, the luminaires are configured to execute a color creation and matching process that iteratively modifies and evaluates control values for the light sources within the luminaire until the control values necessary to produce the desired color are identified. For example, a luminaire uses stored spectral information for the light sources within the luminaire to determine a location for each light source within a particular color space (e.g., the CIE xyY color space). A desired output color is inputted to the luminaire using a complex color control methodology (e.g., hue-saturation-intensity ("HSI"), red-green-blue ("RGB"), etc.), and is also converted to a location within the color space. The separation (e.g., distance) between the desired output color location and each of the locations corresponding to the light sources is calculated to select initial control values for the light sources. The smaller the distance between a light source location and the desired output color location, the greater the initial control value. The initial control values for each light source are then individually modified by a step size value, the total output of the luminaire is calculated and converted to a location within the color space, and the separation (e.g., distance) between the luminaire output location and the desired color location is calculated. The control values for the light sources are iteratively modified until the luminaire output location is within a threshold value of the desired color output. The light sources in the luminaire are then driven to the identified control values.

The locations described herein generally relate to positions or coordinates within a color space that can be used to map colors in one, two, or three dimensional space, and allow for the consistent identification of colors. Implementations and constructions of the invention are described herein with respect to the CIE xyY color space, but other color spaces can also be used. The separations between the locations within the color space are described generally with respect to distances. However, the separations can also be based on, for example, ratios, products, sums, or differences between wavelengths, frequencies, intensities, polarizations, phases, color temperature, brightness, saturation, etc., and correspond generally to an intervening space or gap between points, values, quantities, objects, locations, and the like.

Figure 3:
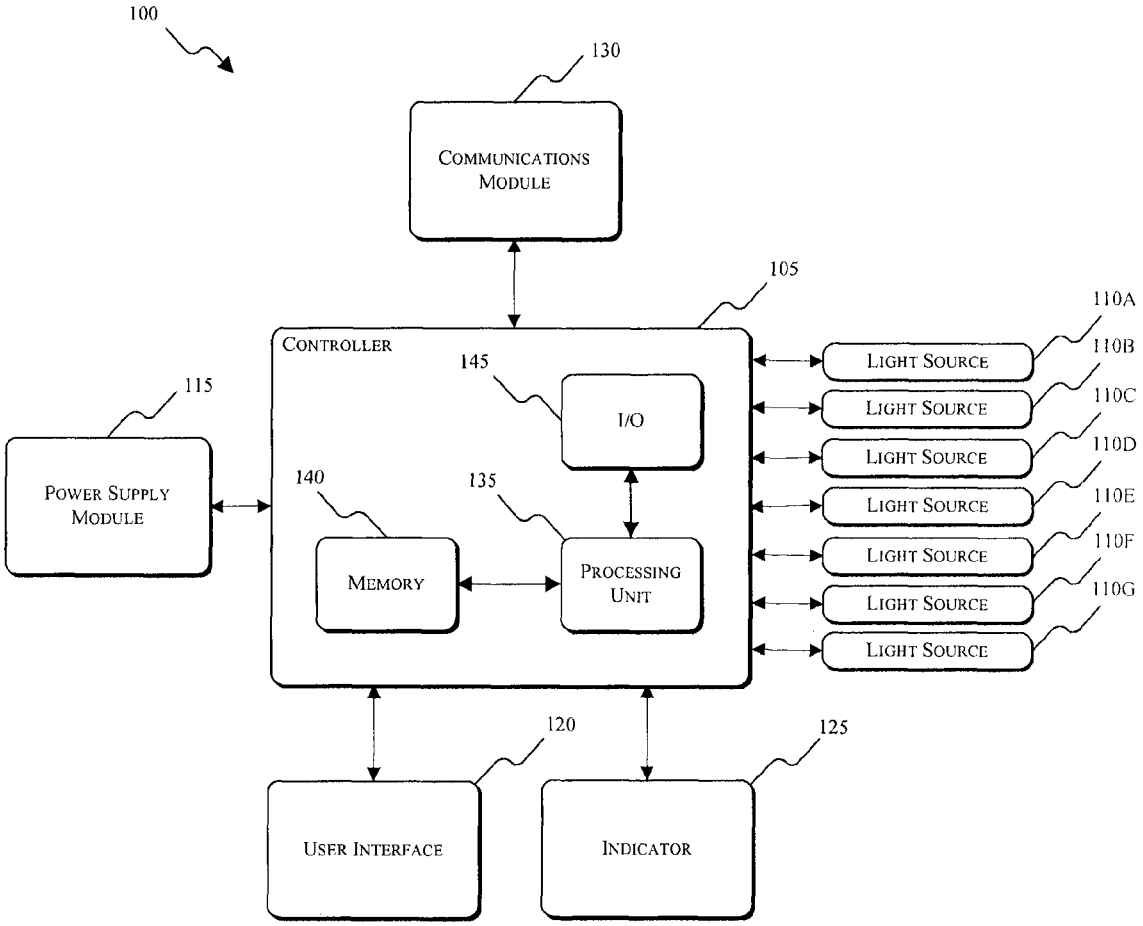
FIG. 3 is a block diagram of a luminaire.
Figure 4:
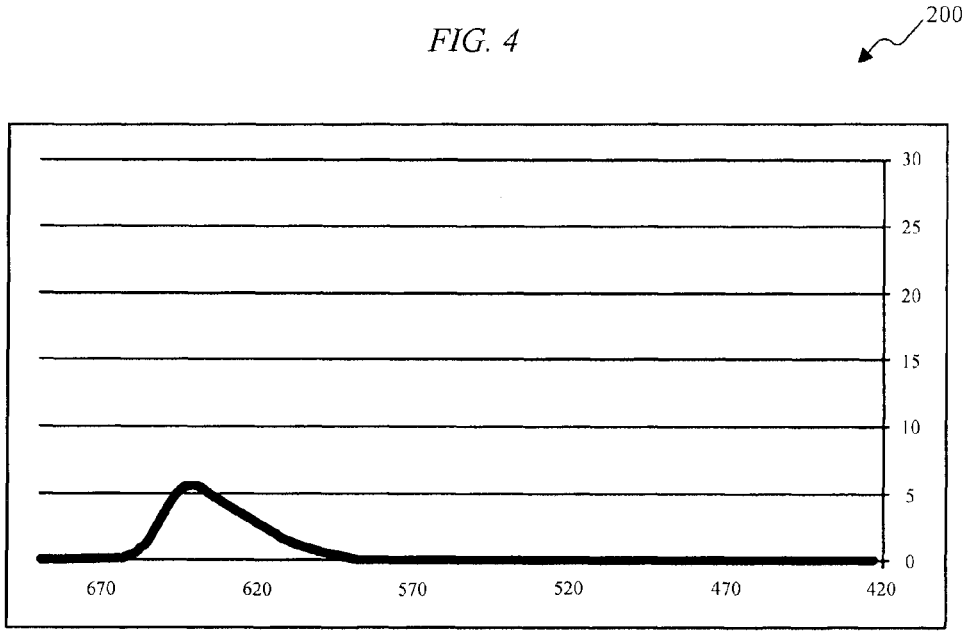
FIG. 4 illustrates an output of a red light source with respect to wavelength.
Figure 5:
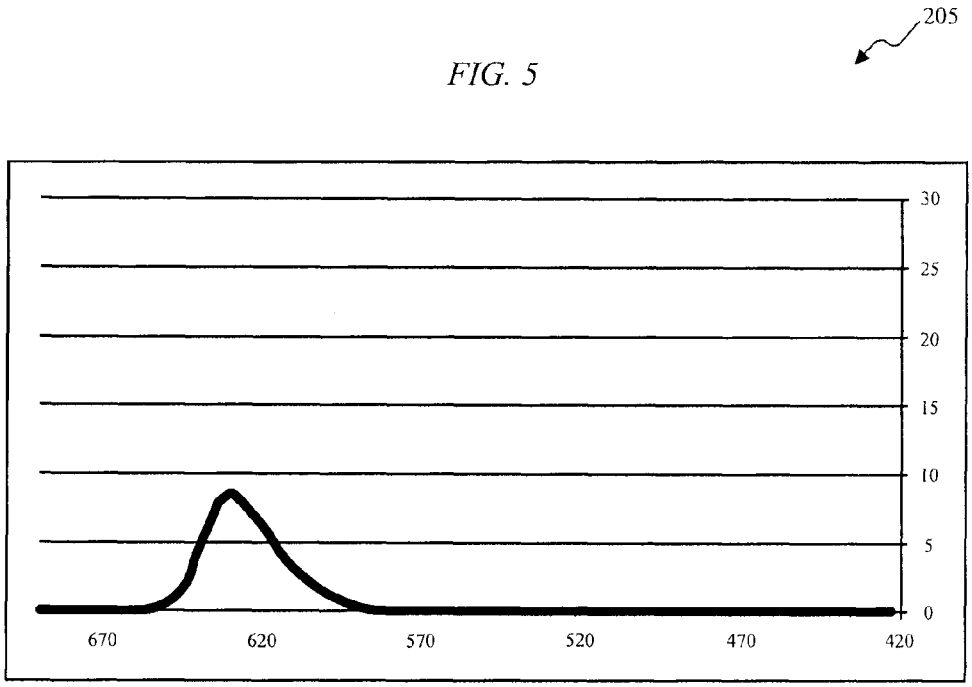
FIG. 5 illustrates an output of a red-orange light source with respect to wavelength.
Figure 6:
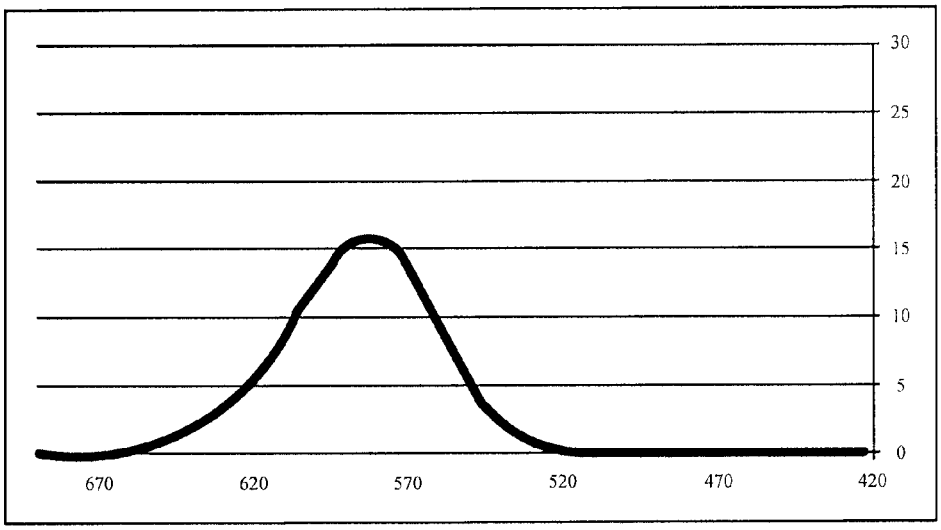
FIG. 6 illustrates an output of a amber light source with respect to wavelength.
Figure 7:
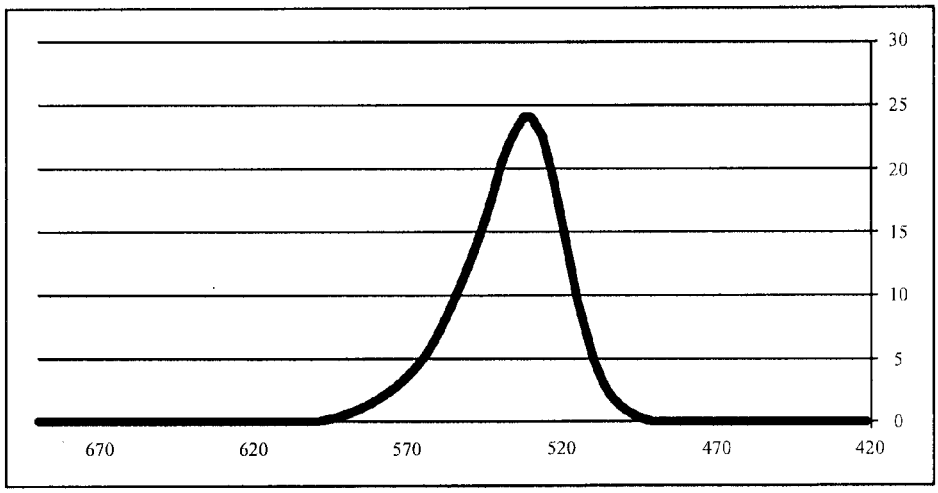
FIG. 7 illustrates an output of a green light source with respect to wavelength.
Figure 8:
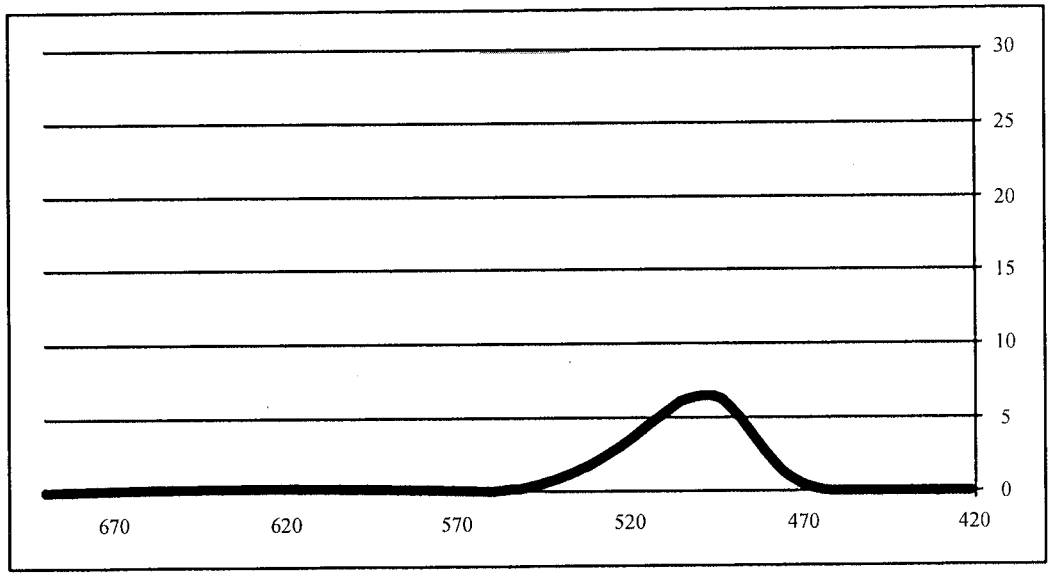
FIG. 8 illustrates an output of a cyan light source with respect to wavelength.
Figure 9:
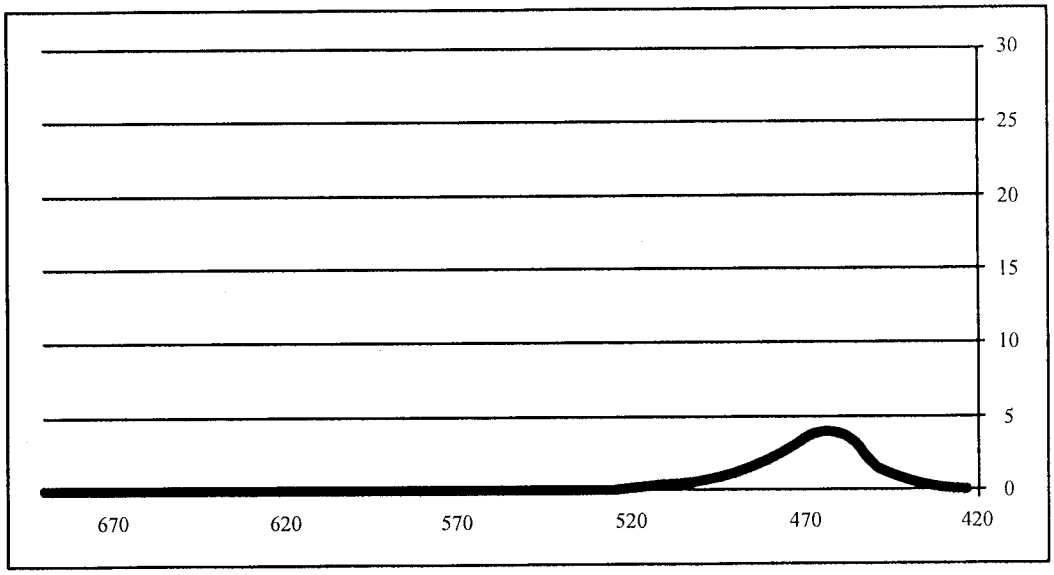
FIG. 9 illustrates an output of a blue light source with respect to wavelength.
Figure 10:
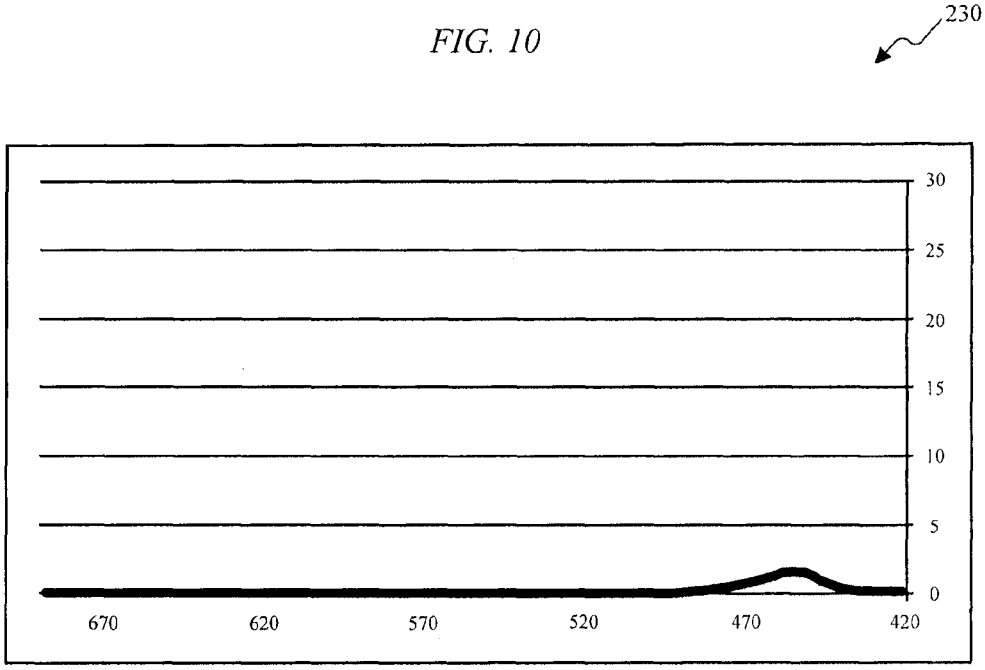
FIG. 10 illustrates an output of an indigo light source with respect to wavelength.

In some implementations, luminaires are used in, for example, a theatre, a hall, an auditorium, a studio, or the like. Each luminaire 100 includes, among other things, a controller 105, a plurality of light sources 110A-110G, a power supply module 115, a user interface 120, one or more indicators 125, and a communications module 130, as shown in FIG. 3. In the illustrated construction, the luminaire 100 includes seven light sources 110A-110G. Each light source is configured to generate light at a specific wavelength or range of wavelengths. For example, the light sources 110A-110G generate light corresponding to the colors red, red-orange, amber, green, cyan, blue, and indigo. In other constructions, light sources that generate different colors are used (e.g., violet, yellow, etc.).

The controller 105 includes, or is connected to an external device (e.g., a computer), which includes combinations of software and hardware that are operable to, among other things, control the operation of one or more of the luminaires, control the output of each of the light sources 110A-110G, and activate the one or more indicators 125 (e.g., LEDs or a liquid crystal display ("LCD")). In one construction, the controller 105 or external device includes a printed circuit board ("PCB") (not shown) that is populated with a plurality of electrical and electronic components that provide power, operational control, and protection to the luminaires. In some constructions, the PCB includes, for example, a processing unit 135 (e.g., a microprocessor, a microcontroller, or another suitable programmable device), a memory 140, and a bus. The bus connects various components of the PCB including the memory 140 to the processing unit 135. The memory 140 includes, for example, a read-only memory ("ROM"), a random access memory ("RAM"), an electrically erasable programmable read-only memory ("EEPROM"), a flash memory, a hard disk, or another suitable magnetic, optical, physical, or electronic memory device. The processing unit 135 is connected to the memory 140 and executes software that is capable of being stored in the RAM (e.g., during execution), the ROM (e.g., on a generally permanent basis), or another non-transitory computer readable medium such as another memory or a disc. Additionally or alternatively, the memory 140 is included in the processing unit 135. The controller 105 also includes an input/output ("I/O") system 145 that includes routines for transferring information between components within the controller 105 and other components of the luminaires or system. For example, the communications module 130 is configured to provide communication between the luminaire 100 and one or more additional luminaires or another control device within a lighting system.

Software included in the implementation of the luminaire 100 is stored in the memory 140 of the controller 105. The software includes, for example, firmware, one or more applications, program data, one or more program modules, and other executable instructions. The controller 105 is configured to retrieve from memory and execute, among other things, instructions related to the control processes and methods described below. For example, the controller 105 is configured to execute instructions retrieved from the memory 140 for performing a mathematical transformation of a control value to a value that is required to drive the light sources 110A-110G to produce a desired color. In other constructions, the controller 105 or external device includes additional, fewer, or different components.

The PCB also includes, among other things, a plurality of additional passive and active components such as resistors, capacitors, inductors, integrated circuits, and amplifiers. These components are arranged and connected to provide a plurality of electrical functions to the PCB including, among other things, filtering, signal conditioning, or voltage regulation. For descriptive purposes, the PCB and the electrical components populated on the PCB are collectively referred to as the controller 105.

The user interface 120 is included to control the luminaire 100 or the operation of a lighting system as a whole. The user interface 120 is operably coupled to the controller 105 to control, for example, the output of the light sources 110A-110G. The user interface 120 can include any combination of digital and analog input devices required to achieve a desired level of control for the system. For example, the user interface 120 can include a computer having a display and input devices, a touch-screen display, a plurality of knobs, dials, switches, buttons, faders, or the like. In some constructions, the user interface is separated from the luminaire 100.

The power supply module 115 supplies a nominal AC or DC voltage to the luminaire 100 or system of luminaires. The power supply module 115 is powered by mains power having nominal line voltages between, for example, 100V and 240V AC and frequencies of approximately 50-60 Hz. The power supply module 115 is also configured to supply lower voltages to operate circuits and components within the luminaire 100. In other constructions, the luminaire 100 is powered by one or more batteries or battery packs.

As illustrated in FIG. 3, the controller 105 is connected to light sources 110A-110G. In other constructions, the controller 105 is connected to, for example, red, green, and blue ("RGB") light sources, red, green, blue, and amber ("RGBA") light sources, red, green, blue, and white ("RGBW") light sources, or other combinations of light sources. A seven light source implementation is illustrated because it is operable to reproduce substantially the entire spectrum of visible light. In other implementations, eight or more light sources are used to further enhance the luminaires ability to reproduce visible light.

Figure 11:
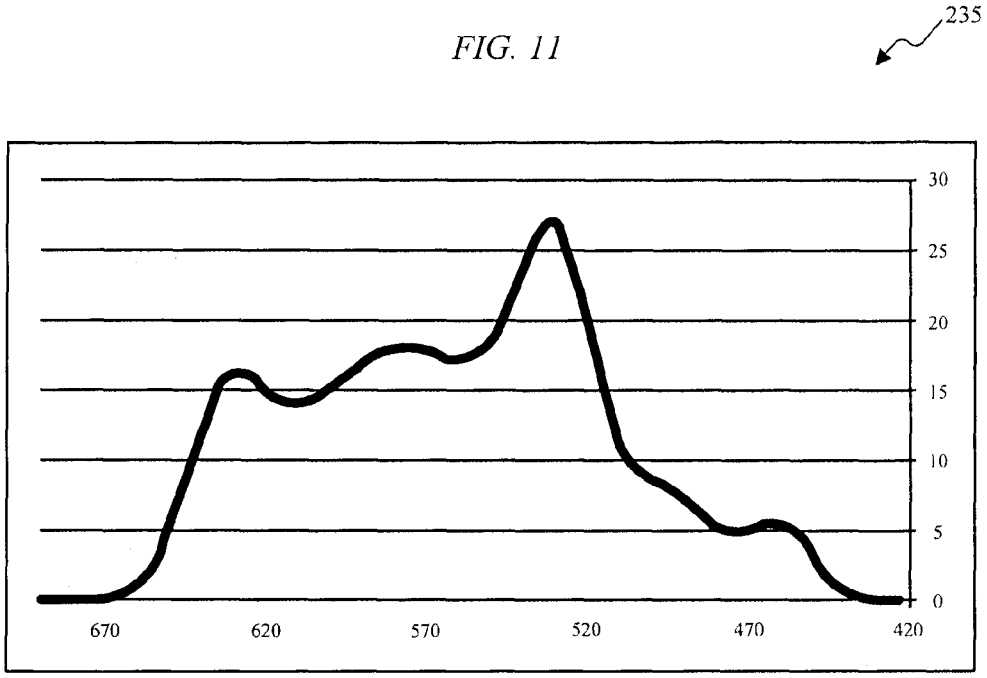
FIG. 11 illustrates a total output of a luminaire with respect to wavelength.
Figure 12:
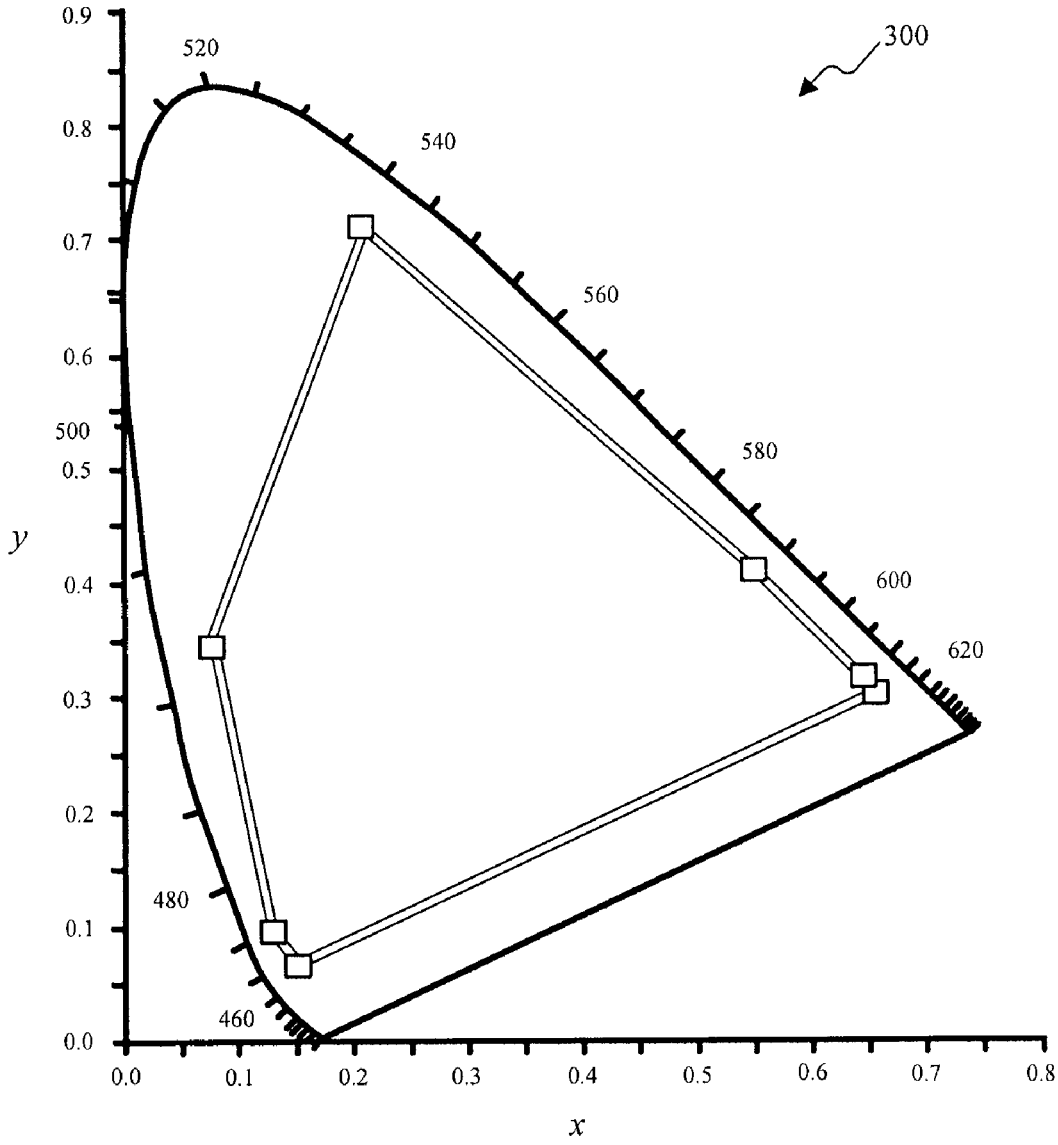
FIG. 12 illustrates a gamut of a luminaire.
Figure 13:
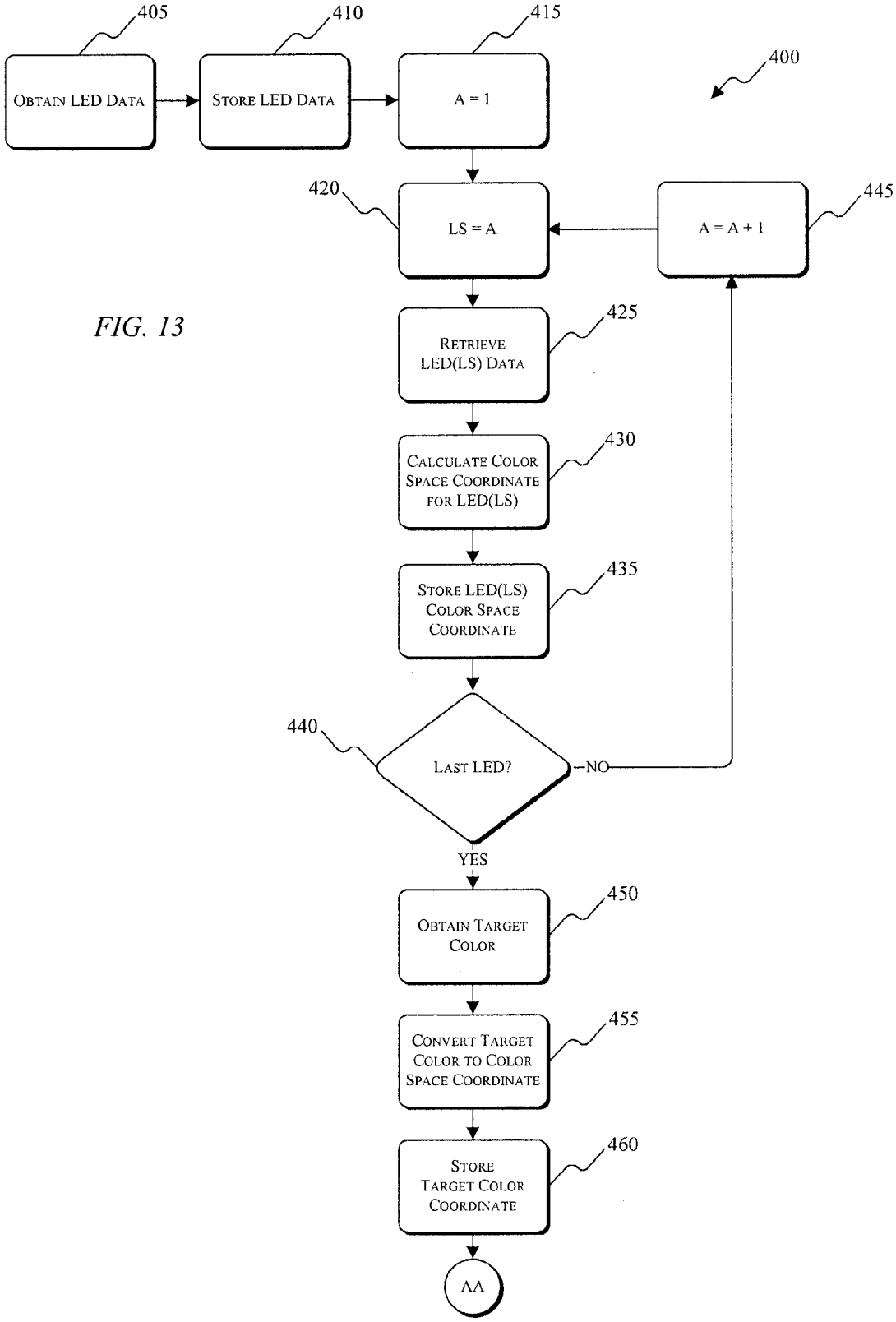
FIGS. 13-19 are a process for color creation and matching according to an implementation of the invention.

FIGS. 4-11 illustrate spectral data corresponding to the outputs of a variety of light sources for the luminaire having the gamut illustrated in FIG. 12. The spectral data for each of the light sources is sampled or gathered, for example, at the time of manufacture. The x-axis of each graph corresponds to a wavelength of light in nanometers ("nm"), and the y-axis of each graph corresponds to a magnitude or intensity of the output of the light source. FIGS. 4-10 correspond to a luminaire that includes seven light sources and represent the spectral output data 200 for a red light source, the spectral output data 205 for a red-orange light source, the spectral output data 210 for an amber light source, the spectral output data 215 for a green light source, the spectral output data 220 for a cyan light source, the spectral output data 225 for a blue light source, and the spectral output data 230 for a indigo light source. FIG. 11 illustrates the spectral data 235 for a resultant total output of the luminaire when the spectral output data 200-230 for each of the light sources in the luminaire is combined. The spectral data shown in FIGS. 4-11 is stored in a memory of the luminaire as a table or multiple tables of values. The values associated with the tables are accessed or retrieved to calculate an output of the luminaire without having to activate the light sources and use light sensors. Spectral data can be gathered in a similar manner for luminaires including different numbers or colors of light sources.

FIG. 12 illustrates the available color gamut 300 for the luminaire that is represented by the spectral data in FIGS. 4-11. As such, only colors that fall within or on the illustrated color gamut polygon are reproducible by the luminaire. If a desired color is not within the available gamut, the desired color coordinate is shifted toward a white point until it is capable of being reproduced by the luminaire. The white point can be user selectable and is within the available color gamut. As described above, due to variations in the output characteristics of individual light sources within the luminaire, the spectral data is used to adjust the output intensity values of the luminaire until the output of the luminaire is within a threshold or error value. For example, the output of the luminaire is converted to a coordinate within the CIE xyY color space. The distance between the output coordinate and a desired coordinate is calculated. The calculated distance is compared to the threshold value. If the distance between the two coordinates is less than or equal to the threshold value, the light sources in the luminaire have been successfully color matched and are illuminated at the determined intensity values.

The CIE xyY color space represents x-coordinates with values between 0.0 and 0.8, and y-coordinates with values between 0.0 and 0.9. To avoid floating point calculations, 16-bit integers are used in some constructions to represent both the x-coordinate and the y-coordinate. An integer value of zero corresponds to a coordinate of 0.0, and an integer value of 32,767 corresponds to a coordinate of 1.0. Therefore, some constructions of the invention achieve a resolution of 1/32,767 or approximately 0.00003.

FIGS. 13-19 are a process 400 for color creation and matching. The process 400 begins with obtaining LED data (step 405). The LED data includes, for example, spectral data associated with the output of each of the LED light sources within a luminaire or light fixture. In some implementations, the LED data corresponds to the output intensities of the LED light sources with respect to wavelength. At step 405, the LED data can be obtained using a spectrometer or, alternatively, be retrieved from a memory. After the LED data has been obtained, the LED data is stored in either a volatile or non-volatile memory (step 410). If the LED data had already been saved to a non-volatile memory (e.g., a ROM), the LED data can be retrieved and stored in, for example, a RAM or similar memory used to store information necessary for the execution of the process 400. In some implementations, the LED data can be, for example, modified, normalized, or compensated to account for variations in the output of the light sources that result from the effects of time, temperature, etc. For example, the outputs of the light sources vary as the temperatures of the light sources vary. The outputs of the light sources also vary throughout the life of the light sources (e.g., output can decrease as the light source ages). The relationships between the outputs of the light sources and these and other conditions can be determined and stored in, for example, the memory 140. The outputs of the light sources can then be compensated for these variations by retrieving the relationships from memory and adjusting the output of the light sources accordingly. The remaining steps of the process 400 are described in an iterative manner for descriptive purposes. Various steps described herein with respect to the process 400 are capable of being executed simultaneously, in parallel, or in an order that differs from the illustrated serial and iterative manner of execution.

At step 415, a first variable, A, is initialized or set equal to one. A light source variable, LS, is then set equal to the first variable, A, (step 420) to select the first of the plurality of light sources within the luminaire. The LED data associated with the first LED is then retrieved from memory (step 425). The retrieved LED data is used to calculate a color space coordinate for the first LED within the specified color space (e.g., the CIE xyY color space) (step 430), as described above. The color space coordinate for the first LED is then stored in memory (step 435), and the selected LED is compared to the final LED (step 440). The selected LED is capable of being compared to the final LED in a variety of ways. For example, each LED is assigned a number, and the number of LEDs in a particular luminaire is stored within a memory of the luminaire. The selected LED corresponding to the variable, A, is compared to the number of LEDs in the luminaire. If the selected LED is not the last LED light source in the luminaire, the first variable, A, is incremented by one (step 445), and the light source variable, LS, is reset to the new value of the first variable, A (step 420). If the selected LED is the last LED light source in the luminaire, a target color is obtained (step 450).

The target color is obtained from, for example, a controller or user interface which allows a user to enter a desired target color, or for a target color to be retrieved from memory (e.g., as part of a program or sequence of desired colors). Although the step of obtaining a target color is illustrated as immediately following step 440, the step of obtaining a target color may happen temporally well after the final LED color space coordinate is saved to memory. For example, the calculation and storage of the color space coordinates for each of the LED light sources in the luminaire may be part of an initialization or manufacturing procedure. In such an instance, the process 400 waits to receive a target color before proceeding. After the target color has been obtained, the target color is converted to a color space coordinate (i.e., using the same color space as the LED color space coordinates) (step 455). The target color space coordinate is then stored to memory (step 460) and the process 400 proceeds to section AA shown in and described with respect to FIG. 14.

Figure 14:
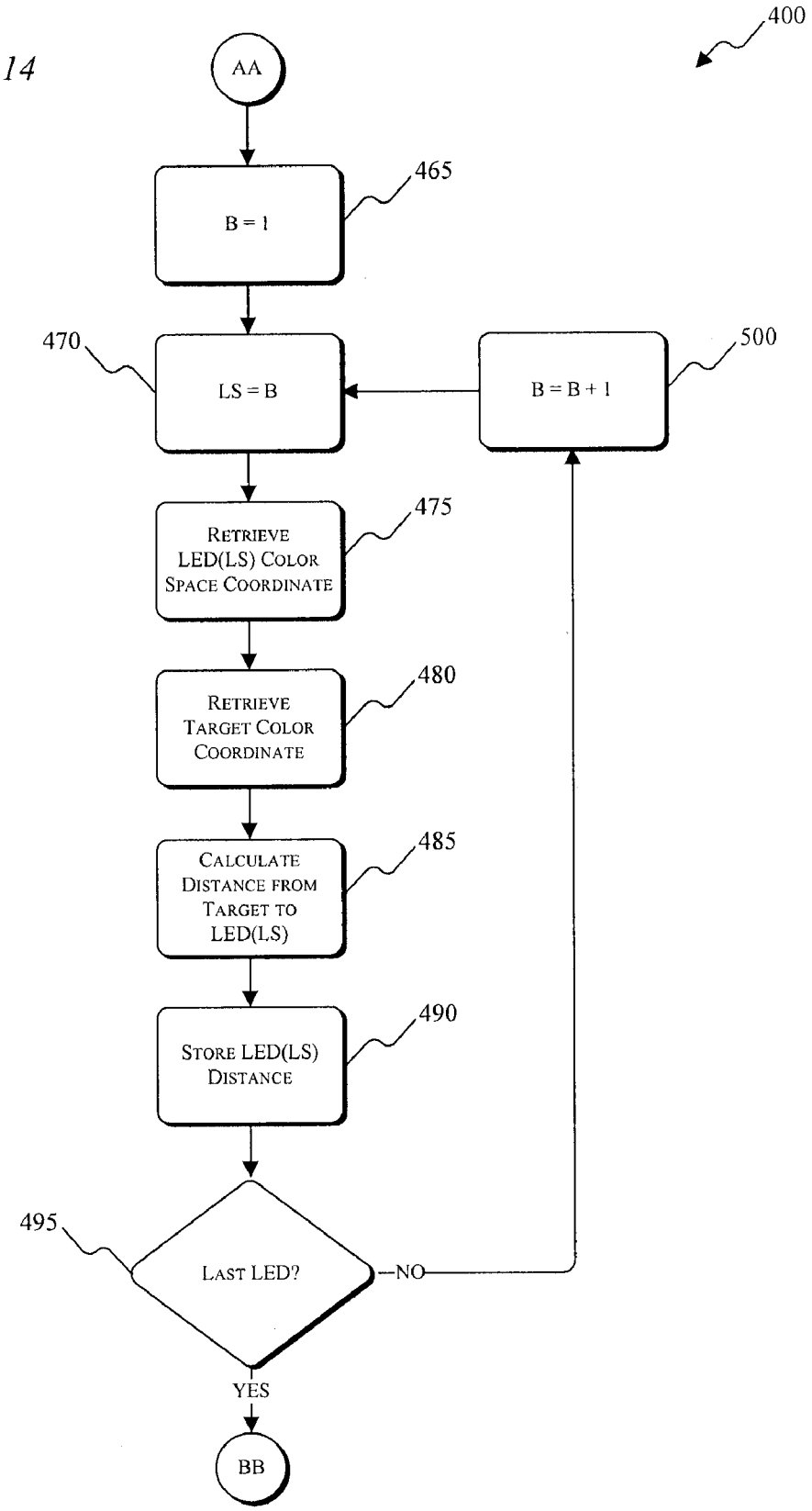

With reference to FIG. 14, a second variable, B, is initialized or set equal to one (step 465), and the light source variable, LS, is set equal to B (e.g., the first LED light source) (step 470). At step 475, the color space coordinate for the selected LED light source is retrieved from memory. The target color space coordinate is also retrieved from memory (step 480). The distance between the target color space coordinate and the color space coordinate for the first LED light source is then calculated (step 485). For example, if the target color space coordinate is designated by an x-coordinate, $x_T$, and a y-coordinate, $y_T$, and the first LED light source is designated by an x-coordinate, $x_1$, and a y-coordinate, $y_1$, the distance, $D_1$, between the target color space coordinate and the first LED light source coordinate can be calculated as shown below in EQN. 7. EQN. 7 can be used to calculate the distance between each of the LED light sources in the luminaire and the target color space coordinate.

$$D_1=\sqrt{(x_T-x_1)^2+(y_T-y_1)^2} \qquad \text{EQN. 7}$$

The calculated distance, $D_1$, for the first LED light source is then stored in memory (step 490). The selected LED light source corresponding to the second variable, B, is compared to the number of LEDs in the luminaire. If the selected LED light source is not the last LED light source in the luminaire, the second variable, B, is incremented by one (step 500) and the light source variable, LS, is reset to the new value of the second variable, B (step 470). If the selected LED light source is the last LED light source in the luminaire, the process 400 proceeds to section BB shown in and described with respect to FIG. 15.

Figure 15:
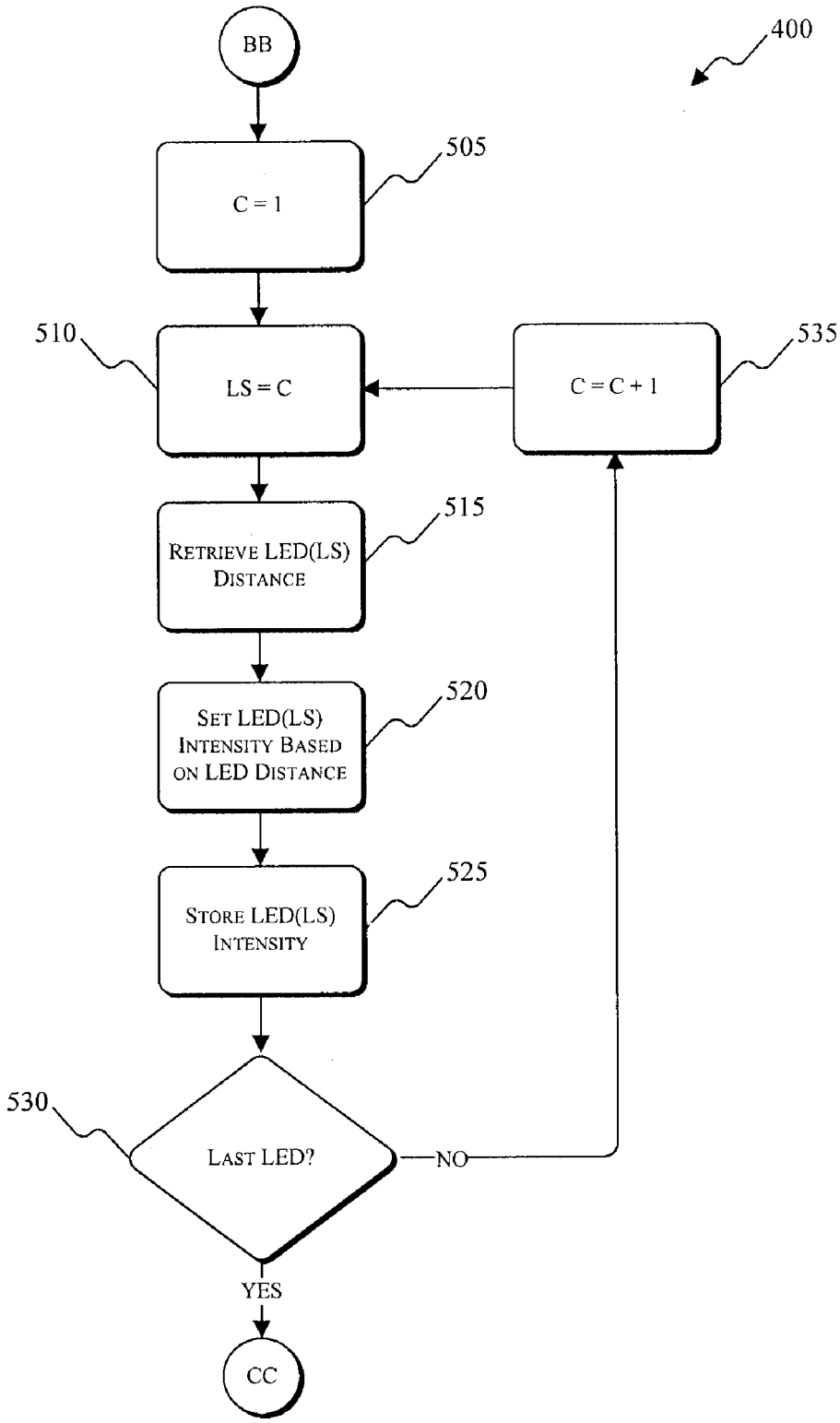

With reference to FIG. 15, a third variable, C, is initialized or set equal to one (step 505), and the light source variable, LS, is set equal to C (e.g., the first LED light source) (step 510). At step 515, the distance between the first LED light source and the target color coordinate is retrieved from memory. An intensity level for the first LED light source is then set based on the retrieved distance (step 520), and the intensity level is stored to memory (step 525). For example, the greater the distance between the LED light source color space coordinate and the target color space coordinate, the lower the initial intensity value is set. As such, the distance between the LED light source color space coordinate, and the target color space coordinate and the initial output intensity value for the LED light source are inversely related. In some implementations, the inverse relationship is a linear inverse relationship. In other implementations, the inverse relationship is an exponential, logarithmic, or the like. The LED light source intensities are, for example, one byte. Therefore, each LED light source intensity has a value between 0 (i.e., no output) and 255 (i.e., full-scale). After the initial output intensity value for LED light source is set, the selected LED light source corresponding to the third variable, C, is compared to the number of LEDs in the luminaire (step 530). If the selected LED light source is not the last LED light source in the luminaire, the third variable, C, is incremented by one (step 535) and the light source variable, LS, is reset to the new value of the third variable, C (step 510). If the selected LED light source is the last LED light source in the luminaire, the process 400 proceeds to section CC shown in and described with respect to FIG. 16.

Figure 16:
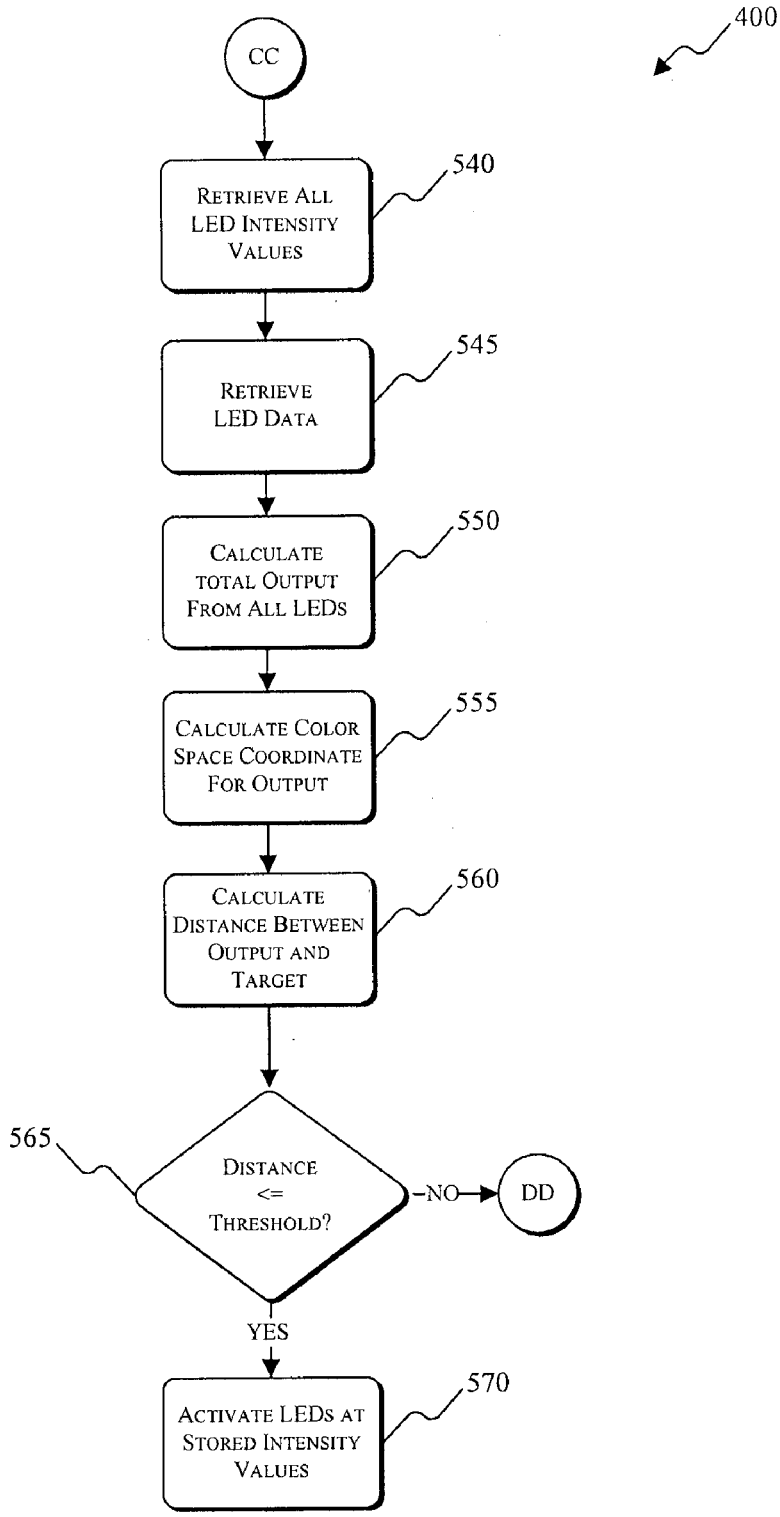

At step 540 shown in FIG. 16, all of the LED light source intensity values are retrieved or accessed from memory. The stored LED data is also retrieved from memory (step 545) such that the total output of the luminaire (i.e., the output of each LED light source) can be calculated (step 550). For example, the output intensity of each LED light source with respect to wavelength is determined based on the initial output intensity values for each LED light source and the LED data. The output intensities of each LED light source are then combined to produce a set of data corresponding to the total output for the luminaire. The total output of the luminaire is then used to calculate a color space coordinate (step 555) for the total output of the luminaire based on the initial LED light source output intensity values and the color matching functions described above. The distance between the total luminaire output color space coordinate and the target color space coordinate is then calculated (step 560) using, for example, EQN. 7 above. The distance calculated at step 560 is compared to a threshold value (step 565). The threshold value is, for example, a distance value, a percent-error value, a mean square error ("MSE"), or the like. If the distance is not less than or equal to the threshold value, the process 400 proceeds to section DD shown in and described with respect to FIG. 17. If the initial output intensity values for the LED light sources resulted in a luminaire output color space coordinate that was less than or equal to the threshold value, the LED light sources are driven or activated at the stored initial output intensity values (step 570).

Figure 17:
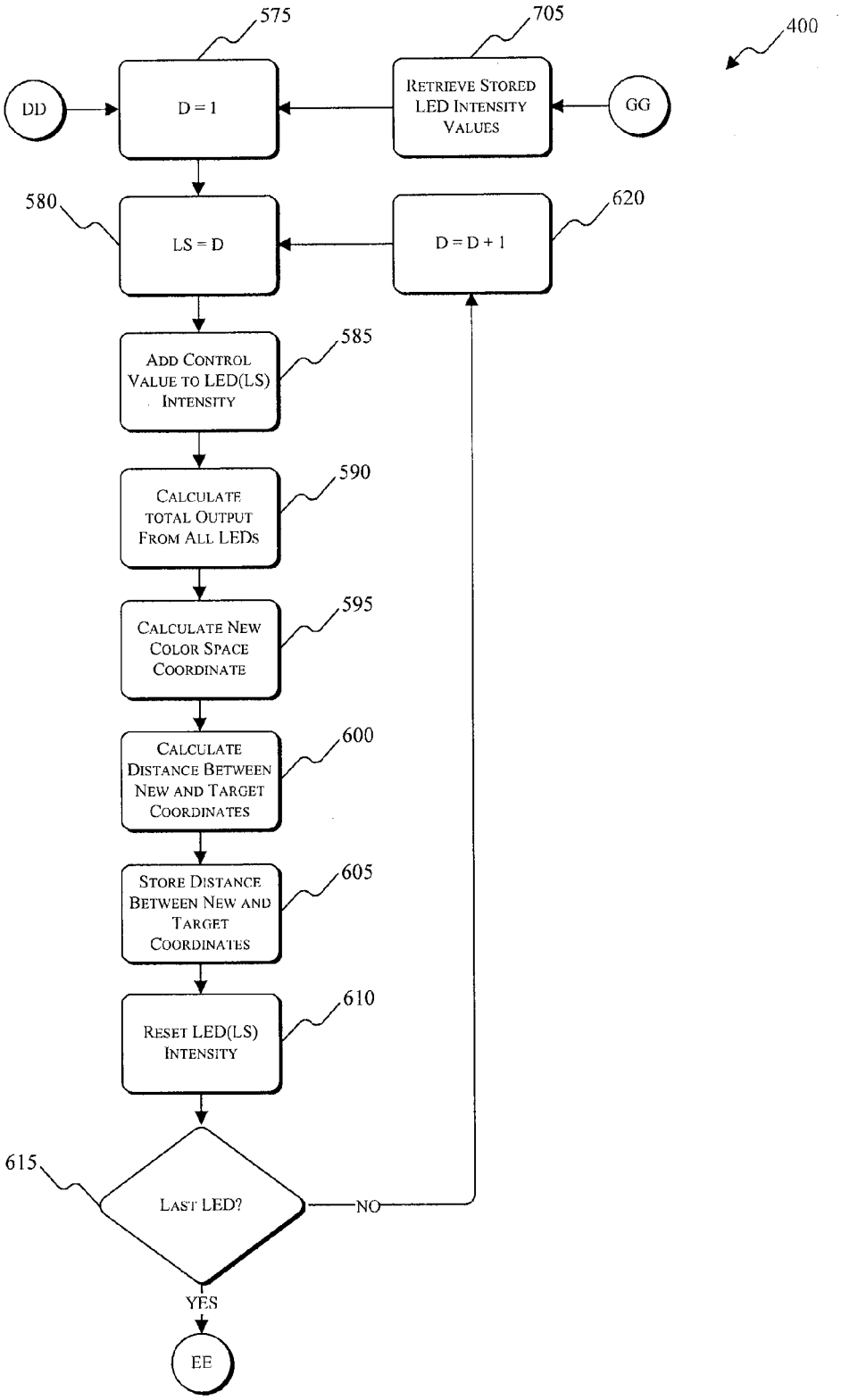

With reference to FIG. 17 and step 575, a fourth variable, D, is initialized or set equal to one, and the light source variable, LS, is set equal to D (e.g., the first LED light source) (step 580). At step 585, a step size value is added to the output intensity value of the selected LED light source. The step size value is based on, for example, the separation or distance between the total luminaire output color space coordinate and the target color space coordinate (e.g., the step size value is proportional to the separation between the total luminaire output color space coordinate and the target color space coordinate). For example, if the distance between the total luminaire output color space coordinate and the target color space coordinate is greater than or equal to one or more threshold values, the step size value is set proportionally large. If the distance between the total luminaire output color space coordinate and the target color space coordinate is less than or equal to one or more threshold values, the step size value is set proportionally small. In some implementations, the step size value is a percentage value, an incremental intensity value, or the like. For example, if the step size value is 5%, the output intensity value for the LED light source is increased by 5%. Using the new output intensity value for the selected LED light source, the previously retrieved initial output intensity values for the remaining LED light sources (i.e., the un-modified initial output intensity values), and the previously retrieved LED data, the total output of the luminaire is recalculated (step 590). The color space coordinate for total luminaire output is also recalculated (step 595). The distance between the new color space coordinate for the total luminaire output and the target color coordinate is calculated (step 600), and the distance between the new color space coordinate for the total output and the target color coordinate is stored to memory (step 605). The output intensity value for the selected LED light source is then reset to the previous (i.e., un-modified) output intensity value (step 610). The selected LED light source corresponding to the fourth variable, D, is compared to the number of LEDs in the luminaire (step 615). If the selected LED light source is not the last LED light source in the luminaire, the fourth variable, D, is incremented by one (step 620) and the light source variable, LS, is reset to the new value of the fourth variable, D (step 580). The process 400 repeats steps 585-615 until the step size value has been added to each output intensity value for the LED light sources. If the selected LED light source is the last LED light source in the luminaire, the process 400 proceeds to section EE shown in and described with respect to FIG. 18.

Figure 18:
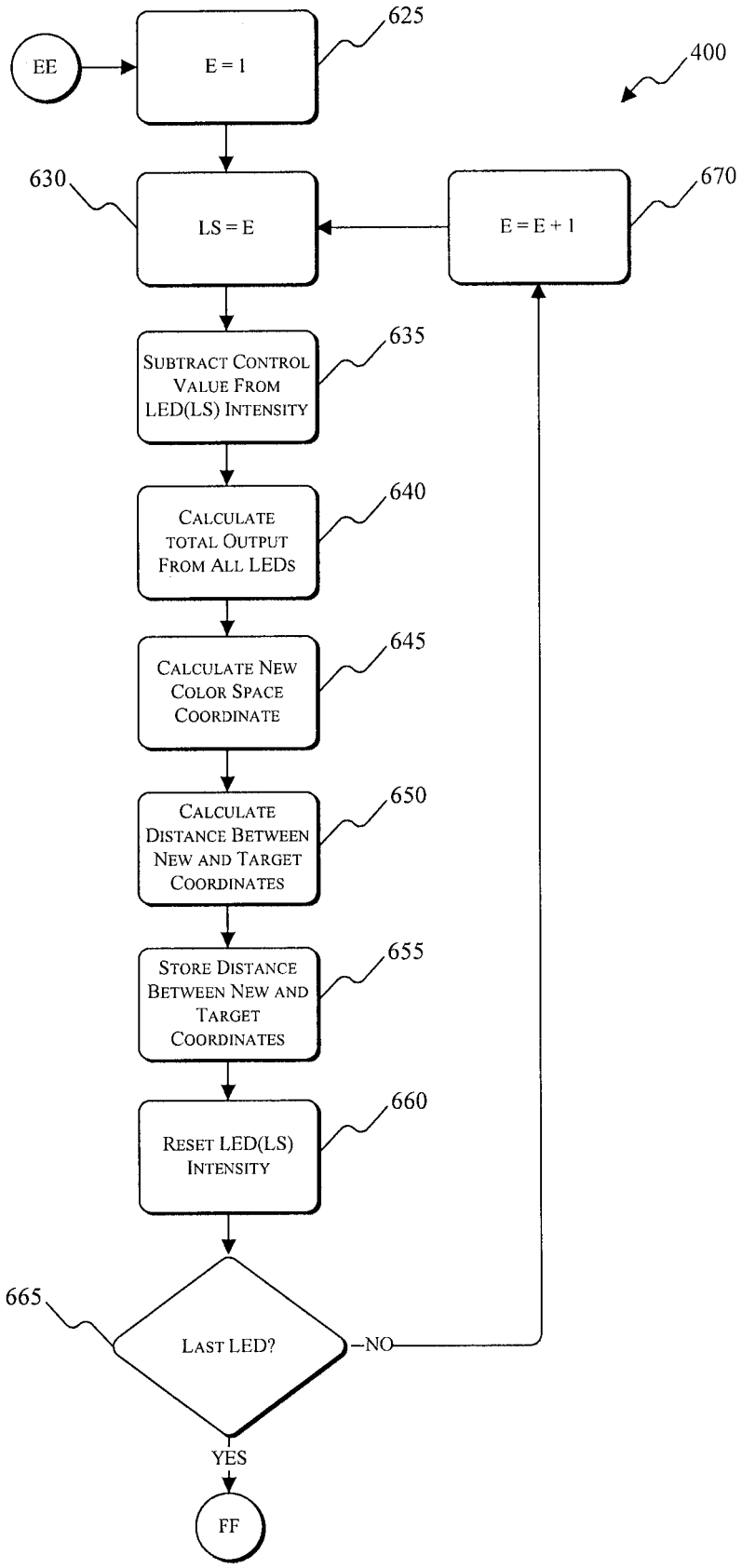

At step 625 in FIG. 18, a fifth variable, E, is initialized or set equal to one (step 625), and the light source variable, LS, is set equal to the fifth variable, E (e.g., the first LED light source) (step 630). At step 635, a step size value is subtracted from the output intensity value of the selected LED light source. As described above, in some implementations, the step size value is based on the separation or distance between the total luminaire output color space coordinate and the target color space coordinate, and the step size value is a percentage value, a decremental intensity value, or the like. For example, if the step size value is 5%, the output intensity value for the LED light source is decreased by 5%. Using the new output intensity value for the selected LED light source, the previously retrieved initial output intensity values for the remaining LED light sources, and the previously retrieved LED data, the total output of the luminaire is recalculated (step 640). The color space coordinate for total luminaire output is also recalculated (step 645). The distance between the new color space coordinate for the total luminaire output and the target color coordinate is calculated (step 650), and the distance between the new color space coordinate for the total output and the target color coordinate is stored in memory (step 655). The output intensity value for the selected LED light source is then reset to the previous output intensity value (step 660). The selected LED light source corresponding to the fifth variable, E, is compared to the number of LEDs in the luminaire (step 665). If the selected LED light source is not the last LED light source in the luminaire, the fifth variable, E, is incremented by one (step 670), and the light source variable, LS, is reset to the new value of the fifth variable, E (step 630). The process 400 repeats steps 635-665 until the step size value has been subtracted from each output intensity value for the LED light sources. If the selected LED light source is the last LED light source in the luminaire, the process 400 proceeds to section FF shown in and described with respect to FIG. 19. In some implementations, the addition and subtraction of the step size value to the output intensity of each LED light source are performed consecutively as opposed to adding the step size value to the output intensity of each LED source and then subtracting the step size value from each light source. In other implementations, subtraction of the step size value is performed before the addition of the step size value. Additionally or alternatively, the step size value varies between the addition and subtraction or from light source to light source based on, for example, initial intensity values, a calculated distance, or another feedback criterion.

Figure 19:
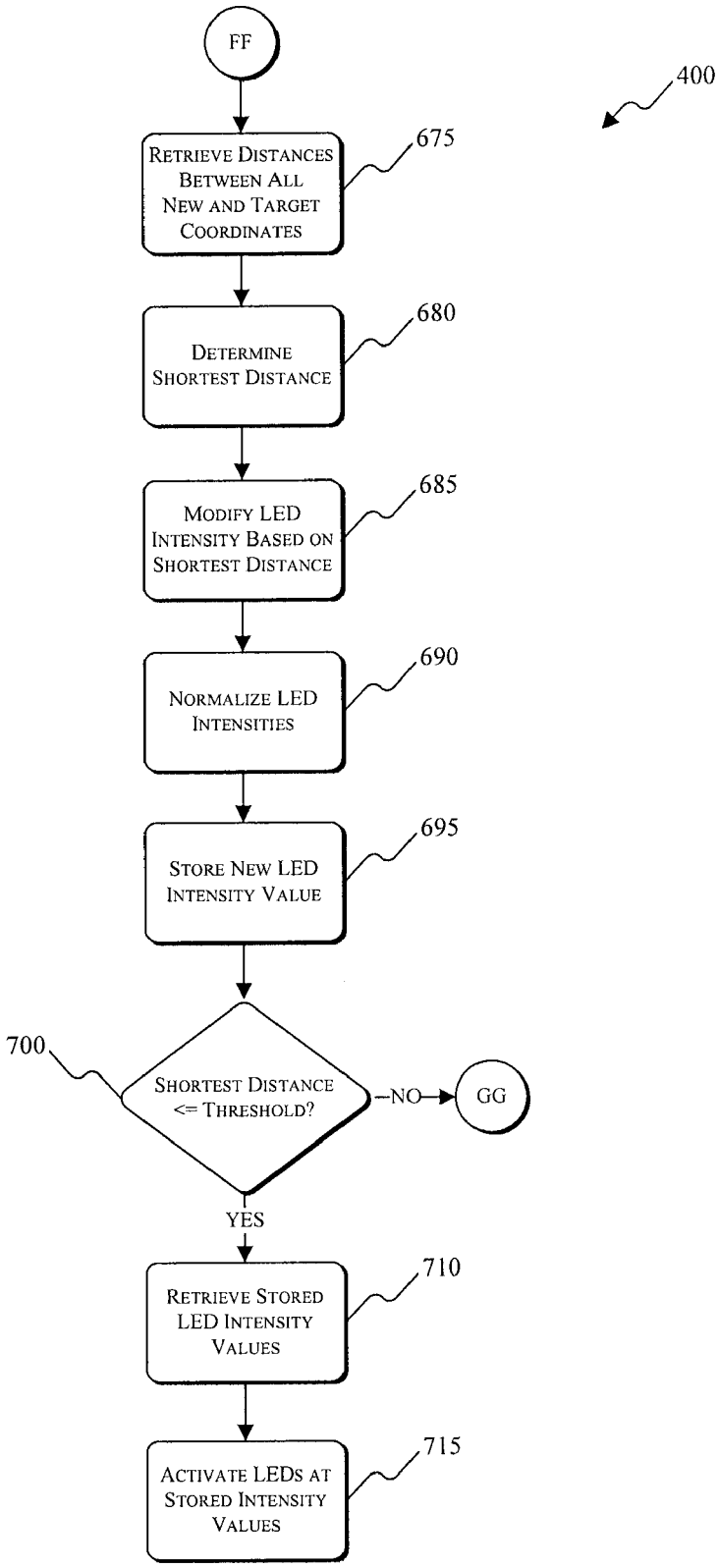

With reference to FIG. 19, after the step size value has been added to and subtracted from the stored intensity values for each of the LED light sources, the stored distances associated with total luminaire output for each of the modified intensity values are retrieved or accessed from memory (step 675). For example, a seven light source luminaire has fourteen distance values stored in memory corresponding to the addition and subtraction of a step size value from the stored output intensity values for each light source. The retrieved distances are then compared to one another to determine the shortest distance (step 680). The shortest distance value corresponds to the set of output intensity values that resulted in the least amount of error (i.e., the addition or subtraction of the step size value that resulted in the most beneficial change in the output of the luminaire). After the shortest distance has been identified, the stored output intensity values are modified (step 685) to correspond to the output intensity values that produced the shortest distance. For example, the step size value is added to or subtracted from a single output intensity value.

After the step size value has been added to or subtracted from the output intensity value, the output intensity values of each of the light sources are normalized (step 690). For example, modifying the output intensity values as described above can result in each of the light sources having an output intensity value of less than 100.0%. In such an instance, the light source or light sources having the highest output intensity value are normalized to a 100.0% output intensity value. As an illustrative example, a luminaire including seven light sources has output intensity values for each of the light sources (following step 685) as shown below in Table #1. Because the green light source has the highest output intensity value (i.e., 80.0%), the output intensity value of the green light source is reset to an output intensity value of 100.0%. Increasing the output intensity value from 80.0% to 100.0% (i.e., an increase in the output intensity value of 20.0%) corresponds to a 25.0% modification or change in the output intensity value of the green light source. As such, the output intensity values of each of the remaining light sources are also modified or changed by 25.0% based on the un-normalized output intensity values. For example, the red light source has an un-normalized output intensity value of 40.0%. Increasing the output intensity by 25.0% results in a normalized output intensity value of 50.0%. The output intensity values of the light sources are normalized to ensure or at least approximate the combination of light source output intensity values that produces a maximum lumen output (i.e., a maximum luminous flux) for the luminaire. Although the step of normalizing the light source output intensity values is shown following step 685, the output intensity values can be normalized in the same or a similar manner later in the process 400 (e.g., following step 695, step 700, step 705, or step 710 (all described below)).

TABLE #1

Normalized Light Source Output Intensity Values

| Color | Un-Normalized Intensity | Normalized Intensity |
|---|---|---|
| Red | 40.0% | 50.0% |
| Red-Orange | 50.0% | 62.5% |
| Amber | 60.0% | 75.0% |
| Green | 80.0% | 100.0% |
| Cyan | 30.0% | 37.5% |
| Blue | 10.0% | 12.5% |
| Indigo | 20.0% | 25.0% |

The new output intensity values corresponding to that LED light sources are then stored in memory (step 695). The shortest distance is then compared to the threshold value (step 700). Because the normalization described above modified the output intensities of the light sources proportionally, the ratios of the light source intensities remain the same. As such, the shortest distance that was determined at step 680 remains unchanged and does not need to be recalculated following the normalization of step 690. As described above, the threshold value is, for example, a distance value, a percent-error value, or the like. If the distance is not less than or equal to the threshold value, the process 400 proceeds to section GG shown in and described with respect to FIG. 17 where the new intensity values are retrieved from memory (step 705) and a step size value is again added to and subtracted from the new stored output intensity values. If the distance is less than the threshold value, the new LED light source intensity values are retrieved or accessed from memory (step 710), and the LED light sources are driven or activated at the stored output intensity values (step 715). Additionally, because the process 400 is capable of being executed by the luminaire itself and no powerful central computer is required, each luminaire in a system of luminaires is capable of executing the process 400 in a parallel manner.

Thus, the invention provides, among other things, methods and systems for color creation and matching. Various features and advantages of the invention are set forth in the following claims.

What is claimed is:

1. A method of controlling the output of a light fixture that includes a light source, the method comprising:

determining a desired color location within a color space;

determining a light source location within the color space for the light source;

calculating a first separation between the desired color location and the light source location;

setting a control value for the light source based on the first separation;

modifying the control value for the light source;

calculating a light fixture output based on the modified control value for the light source;

determining a light fixture output location within the color space based on the light fixture output;

calculating a second separation between the light fixture output location and the desired color location; and driving the light source based on the modified control value.

2. The method of claim 1, further comprising comparing the second separation to a threshold value, wherein the driving the light source is based on the comparison.

3. The method of claim 1, further comprising obtaining spectral information for the light source before determining the light source location.

4. The method of claim 1, further comprising normalizing the control value for the light source.

5. The method of claim 1, further comprising calculating a first light fixture output based on the control value for the light source.

6. The method of claim 5, further comprising determining a first light fixture output location within the color space based on the first light fixture output.

7. The method of claim 6, further comprising calculating a third separation between the first light fixture output location and the desired color location.

8. The method of claim 7, further comprising comparing the third separation to a threshold value, wherein the driving the light source is based on the comparison.

9. A method of controlling the output of a light fixture that includes a light source, the method comprising the steps of:

(1) determining a desired color location within a color space;
(2) determining a light source location within the color space for the light source;
(3) calculating a first separation between the desired color location and the light source location;
(4) setting a control value for the light source based on the first separation;
(5) modifying the control value for the light source;
(6) calculating a light fixture output based on the modified control value;
(7) determining a light fixture output location within the color space based on the calculated light fixture output;
(8) calculating a second separation between the light fixture output location and the desired color location;
(9) comparing the second separation to a threshold value;
(10) iteratively performing steps 5-9; and
(11) driving the light source based on the modified control value.

10. The method of claim 9, further comprising the step of obtaining spectral information for the light source before determining the light source location.

11. The method of claim 9, further comprising the step of normalizing the control value for the light source.

12. The method of claim 9, further comprising the step of calculating a first light fixture output based on the control value for the light source.

13. The method of claim 12, further comprising the step of determining a first light fixture output location within the color space based on the first light fixture output.

14. The method of claim 13, further comprising the step of calculating a third separation between the first light fixture output location and the desired color location.

15. The method of claim 14, further comprising the step of comparing the third separation to the threshold value, wherein the driving the light source is based on the comparison.

16. A light fixture comprising:

a light source; and
a controller configured to
determine a desired color location within a color space;
determine a light source location within the color space for the light source;
calculate a first separation between the desired color location and the light source location;
set a control value for the light source based on the first separation;
modify the control value for the light source;
calculate a light fixture output based on the modified control value;
determine a light fixture output location within the color space based on the light fixture output;
calculate a second separation between the light fixture output location and the desired color location;
compare the second separation to a threshold value; and
driving the light source based on the modified control value.

17. The light fixture of claim 16, wherein the controller is further configured to access spectral information for the light source before determining the light source location.

18. The light fixture of claim 16, wherein the controller is further configured to normalize the control value for the light source.

19. The light fixture of claim 16, wherein the light source is one of a red light emitting diode ("LED"), a red-orange LED, an amber LED, a green LED, a cyan LED, a blue LED, and an indigo LED.

20. The light fixture of claim 16, wherein the controller is further configured to calculate a first light fixture output based on the control value for the light source.

21. The light fixture of claim 20, wherein the controller is further configured to determine a first light fixture output location within the color space based on the calculated first light fixture output.

22. The light fixture of claim 21, wherein the controller is further configured to calculate a third separation between the first light fixture output location and the desired color location.

23. The light fixture of claim 22, wherein the controller is further configured to compare the third separation to the threshold value, wherein the driving the light source is based on the comparison.

* * * * *